US007740523B2

(12) United States Patent
Zaiser et al.

(10) Patent No.: US 7,740,523 B2
(45) Date of Patent: Jun. 22, 2010

(54) PORTABLE POWER TOOL WITH A GUIDE CHANNEL

(75) Inventors: Adolf Zaiser, Koengen (DE); Joerg Albrecht, Wolfschlugen (DE); Juergen Stoeger, Neckartailfingen (DE)

(73) Assignee: Robert Bosch GmbH, Stuttgart (DE)

( * ) Notice: Subject to any disclaimer, the term of this patent is extended or adjusted under 35 U.S.C. 154(b) by 533 days.

(21) Appl. No.: 11/570,216

(22) PCT Filed: Nov. 21, 2005

(86) PCT No.: PCT/EP2005/056090

§ 371 (c)(1),
(2), (4) Date: Dec. 7, 2006

(87) PCT Pub. No.: WO2006/072504

PCT Pub. Date: Jul. 13, 2006

(65) Prior Publication Data

US 2007/0175044 A1 Aug. 2, 2007

(30) Foreign Application Priority Data

Dec. 30, 2004 (DE) ..... 10 2004 063 542

(51) Int. Cl.
*B25F 3/00* (2006.01)
*B24B 23/04* (2006.01)

(52) U.S. Cl. ..... 451/344; 30/124; 451/356; 451/456

(58) Field of Classification Search ..... 30/124, 30/475; 451/340, 344, 354, 355, 356, 357, 451/358, 359, 456
See application file for complete search history.

(56) References Cited

U.S. PATENT DOCUMENTS

| | | | | |
|---|---|---|---|---|
| 5,538,040 | A | 7/1996 | Huber et al. | |
| 5,813,903 | A * | 9/1998 | Amano et al. | 451/294 |
| 6,219,922 | B1 * | 4/2001 | Campbell et al. | 30/124 |
| 6,514,131 | B1 * | 2/2003 | Reich et al. | 451/344 |
| 6,746,321 | B2 * | 6/2004 | Link | 451/354 |
| 2002/0028645 | A1 * | 3/2002 | Link | 451/344 |
| 2004/0132393 | A1 | 7/2004 | Reich et al. | |

FOREIGN PATENT DOCUMENTS

| | | |
|---|---|---|
| DE | 35 28 611 | 2/1987 |
| EP | 0 558 253 | 9/1993 |

* cited by examiner

*Primary Examiner*—Timothy V Eley
(74) *Attorney, Agent, or Firm*—Michael J. Striker

(57) ABSTRACT

A portable power tool has at least one housing part (10) and a guide channel (12) for carrying chips and/or abrasive particles away from a working area (14). At least one wall region (16) of the guide channel (12) is movable relative to the housing part (10) for cleaning purposes.

17 Claims, 3 Drawing Sheets

PORTABLE POWER TOOL WITH A GUIDE CHANNEL

RELATED ART

The present invention is directed to a portable power tool with a guide channel for carrying chips and/or abrasive particles away from a working area.

It has already been provided to equip a portable power tool—which includes at least one housing part—with a guide channel to carry away chips and/or abrasive particles. The guide channel is integrated in a housing and is usually formed of several housing parts, each of which includes a wall region of the guide channel. Generic portable power tools can include suction or blower units which are formed by a ventilator which is rotatably driven around an axis of rotation which extends in parallel with a stream of air in the guide channel.

ADVANTAGES OF THE INVENTION

The present invention is directed to a portable power tool with at least one housing part and a guide channel for carrying chips and/or abrasive particles away from a working area.

It is provided that at least one wall region of the guide channel is designed such that it is movable relative to the housing part for cleaning purposes. This makes it much easier to clean the guide channel. Chips which clog or contaminate the guide channel can be removed easily and conveniently, since a clogged and/or contaminated region can be accessed easily by moving the wall region. As a result, with portable power tools in particular which are designed for woodworking, comfort can be increased considerably, since resin residue can be removed easily from the movable wall region or a wall region of the guide channel which is complementary to the movable wall region. The wall region can enclose a subsection of the guide channel around the circumference, or it can be designed as a side wall. Embodiments of the present invention are particularly advantageous in which the wall region extends at least substantially along an entire length of the guide channel.

In this context, "movable" should be understood to mean manual movability in particular. The term is intended to also mean "detachable", "manually detachable", and "pivotable".

Particularly reliable and comfortable movability with a guide having a simple design can be attained when the portable power tool includes a hinge element for opening the wall region away from the housing part.

To fix a closed configuration of the guide channel in place, the portable power tool can advantageously include a manually detachable fixing element and, in particular, a snap-in connection between the wall region and the housing part.

The ejected chips and/or the ejected abrasive particles can be prevented from disturbing the comfort of the operator of the portable power tool when the guide channel for ejecting chips is provided in a direction which is opposite to a working direction. In addition, a handle element for guiding the portable power tool is advantageously located outside of an ejection range of the guide channel and, in fact, above the guide channel or on a top side of the portable power tool in particular.

A refinement of the present invention provides that the guide channel includes a connecting element for connecting a collecting container for the chips and/or abrasive particles. The chips can be collected directly in the collecting container.

The guide channel can be opened when the housing part is fixedly connected with a further wall region of the guide channel and/or forms a further wall region.

The present invention is also directed to a portable power tool with a guide channel for carrying chips and/or abrasive particles away from a working area, and with a blower unit—which is driven such that it can rotate around an axis of rotation—for driving a stream of air in the guide channel.

It is provided that the axis of rotation extends at least substantially orthogonally to a direction of flow of the stream of air in the guide channel. A blower unit with a particularly flat design can be attained, which can produce a flow profile which is homogeneous across a width of the guide channel, particularly in guide channels having a flat design. It can also be attained that the blower unit is suspended on or supported on the blower unit outside of the guide channel, so that the guide channel cannot become clogged in a region where it is suspended or supported.

In this case, "substantially orthogonal" also refers to an angle of inclination which deviates from the perpendicular by less than 30° or which can be realized by moving the suspension of the blower unit out of the guide channel.

Particular advantages can result in the context of planers which include a knife shaft for planing a workpiece, since particularly large chips are produced in this case. As such, the tendency for the guide channel to become clogged is particularly great. In addition, a flat guide channel complements the cylindrical, linear shape of the knife shaft in a particularly advantageous manner.

It can be ensured that the blower unit is always activated when the knife shaft rotates when the blower unit is connected with the knife shaft via a transmission element. In a manner which has a simple design and is economical, the transmission element can be designed as a transmission belt, although designs with transmission gears are also feasible.

When the blower unit includes at least one blade which extends orthogonally to the direction of flow, a flow which is homogeneous across a width of the guide channel can be attained, and a mechanical forwarding of the chips via the blades can advantageously support the stream of air via its convective transport work.

The volume of chips obtained during machining can be reduced when the blade includes at least one sharp edge designed to fragmentize chips.

The energy stored in a cooling air flow of an electric motor of the portable power tool could be fully utilized if the blower unit were driven by the cooling air flow of the electric motor.

DRAWING

Further advantages result from the description of the drawing, below. Exemplary embodiments of the present invention are shown in the drawing. The drawing, the description and the claims contain numerous features in combination. One skilled in the art will also advantageously consider the features individually and combine them to form further reasonable combinations.

DESCRIPTION OF THE EXEMPLARY EMBODIMENTS

Figure 1:
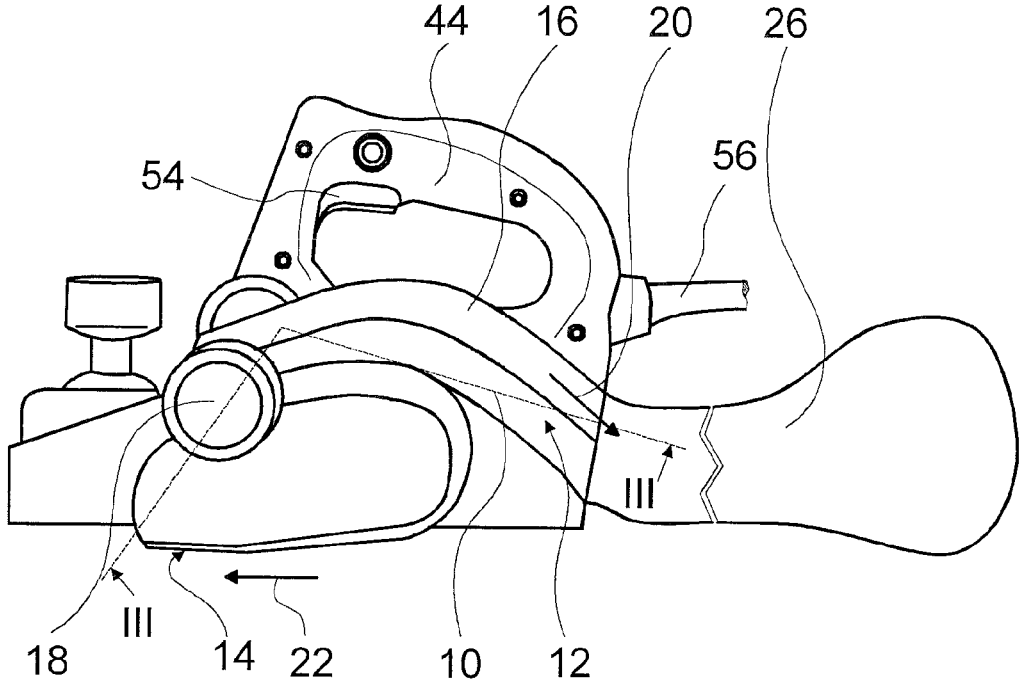
FIG. 1 shows a portable power tool with a guide channel.
Figure 2:
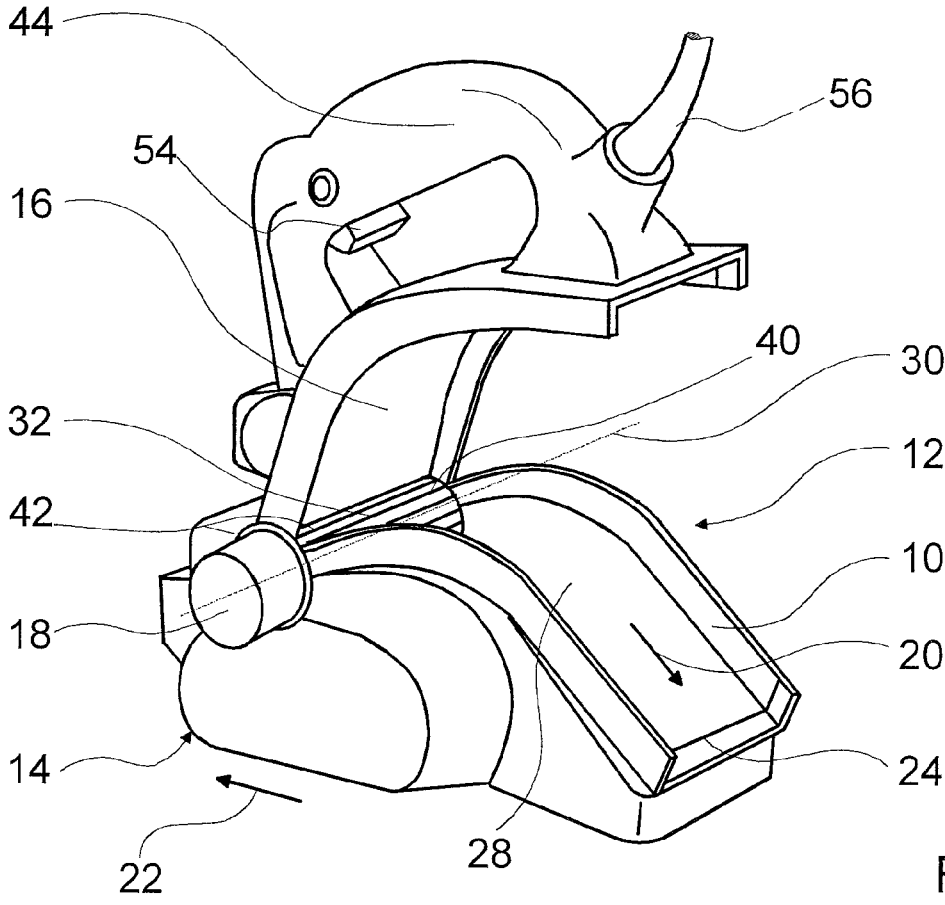
FIG. 2 shows the portable power tool in FIG. 1 with an opened guide channel.

FIGS. 1 and 2 show a portable power tool designed as a hand-guided planer, with a guide channel 12 for guiding chips away from a working area 14 of the portable power tool into an outer space and/or into a collecting container 26—which is designed as a collecting bag—of the portable power tool. The portable power tool includes a multiple-component housing with an upper housing part 44 and a lower housing part 10. Housing parts 10, 44 are pivotably connected with each other via a hinge element 18, and they each include a wall region 16, 28 of guide channel 12. Upper wall region 16 is integrally moulded with upper housing part 44, while lower wall region 28 is integrally moulded with lower housing part 10. As a result, upper wall region 16 is movable and/or pivotable relative to lower housing part 10 via hinge element 18. Using hinge element 18, an operator can open upper housing part 44, including wall region 16, away from lower housing part 10.

A power supply cord 56 and a switch 54 for turning the planer on and off are located on upper housing part 44. An electric current is carried by power supply cord 56 via switch 54 through a not-shown contact element into lower housing part 10 and/or into an electric motor 52 which is located in lower housing part 10, and, in fact, such that an electric circuit is isolated by the contact element when the housing is open.

When housing parts 10, 44 are in the closed state, in which housing parts 10, 44 are locked in position via a snap-in connection, guide channel 12 is limited by wall regions 16, 28. Wall regions 16, 28 each form approximately one-half of a wall of guide channel 12.

Guide channel 12 extends from a working region 14—which is located in a front region of housing part 10 relative to a working direction 22—linearly through the portable power tool and opens toward the back, relative to working direction 22, so that guide channel 12 is provided for ejecting chips in a direction 20 which is opposite to a working direction 22. Both wall regions 16, 28 extend across the entire length of guide channel 12. Guide channel 12 arches over electric motor 52, which is located transversely to the guide channel. In a rear end region, guide channel 12 includes a connecting element 24—which is designed as an annular groove—for connecting collecting container 26. Collecting container 26 has a stiff edge which engages in connecting element 24 when guide channel 12 is closed, so that connecting element 24 fixes collecting container 26 in position in a form-fit manner when the housing is closed.

Figure 4:
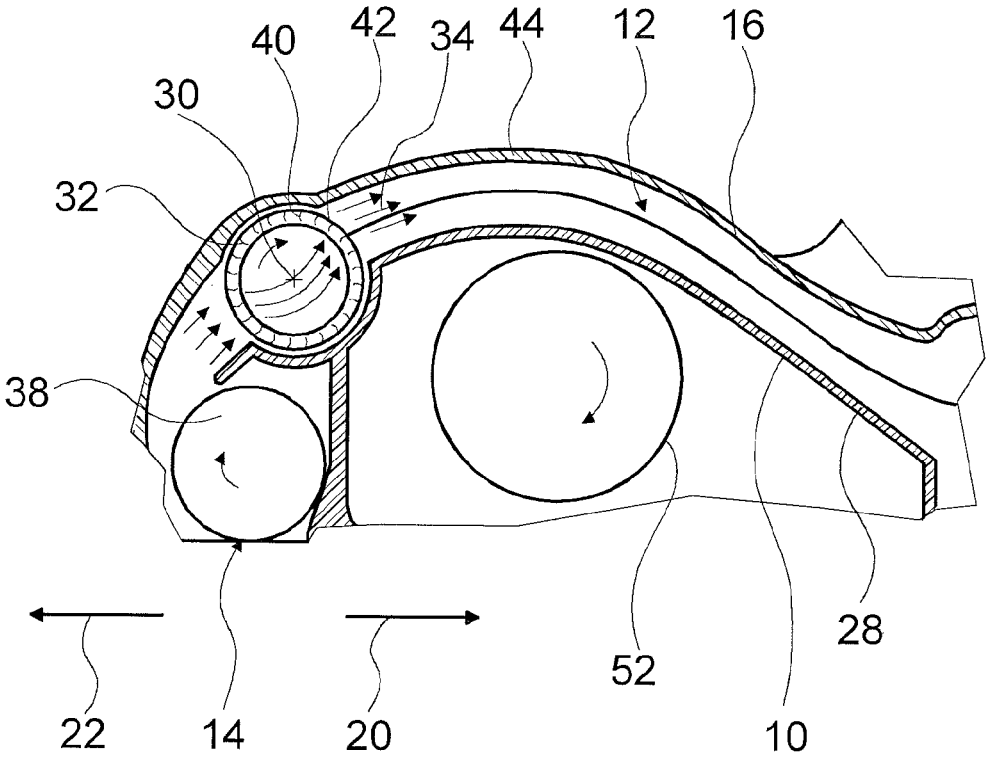
FIG. 4 shows a schematized horizontal sectional view of the portable power tool in FIGS. 1 through 3.

A cylindrical knife shaft 38 for removing chips—which are composed of a wood-like material, in particular—is located in working area 14, and is driven via a drive belt 46 by electric motor 52 of the portable power tool (FIG. 4).

Drive belt 46 runs on a twin belt pulley 48 which is non-rotatably connected with knife shaft 38, and on which drive belt 46 and a further transmission element 50 designed as a drive belt runs. Transmission element 50 transfers a rotary motion of knife shaft 38 to a blower unit 32 designed as a cross-flow fan. Blower unit 32 is rotatably driven via transmission element 50 around an axis of rotation 30 which extends parallel to an axis of rotation of knife shaft 38. Axis of rotation 30 extends orthogonally to a stream of air 34 guided in guide channel 12 and/or to a direction of flow 36 of stream of air 34.

Figure 3:
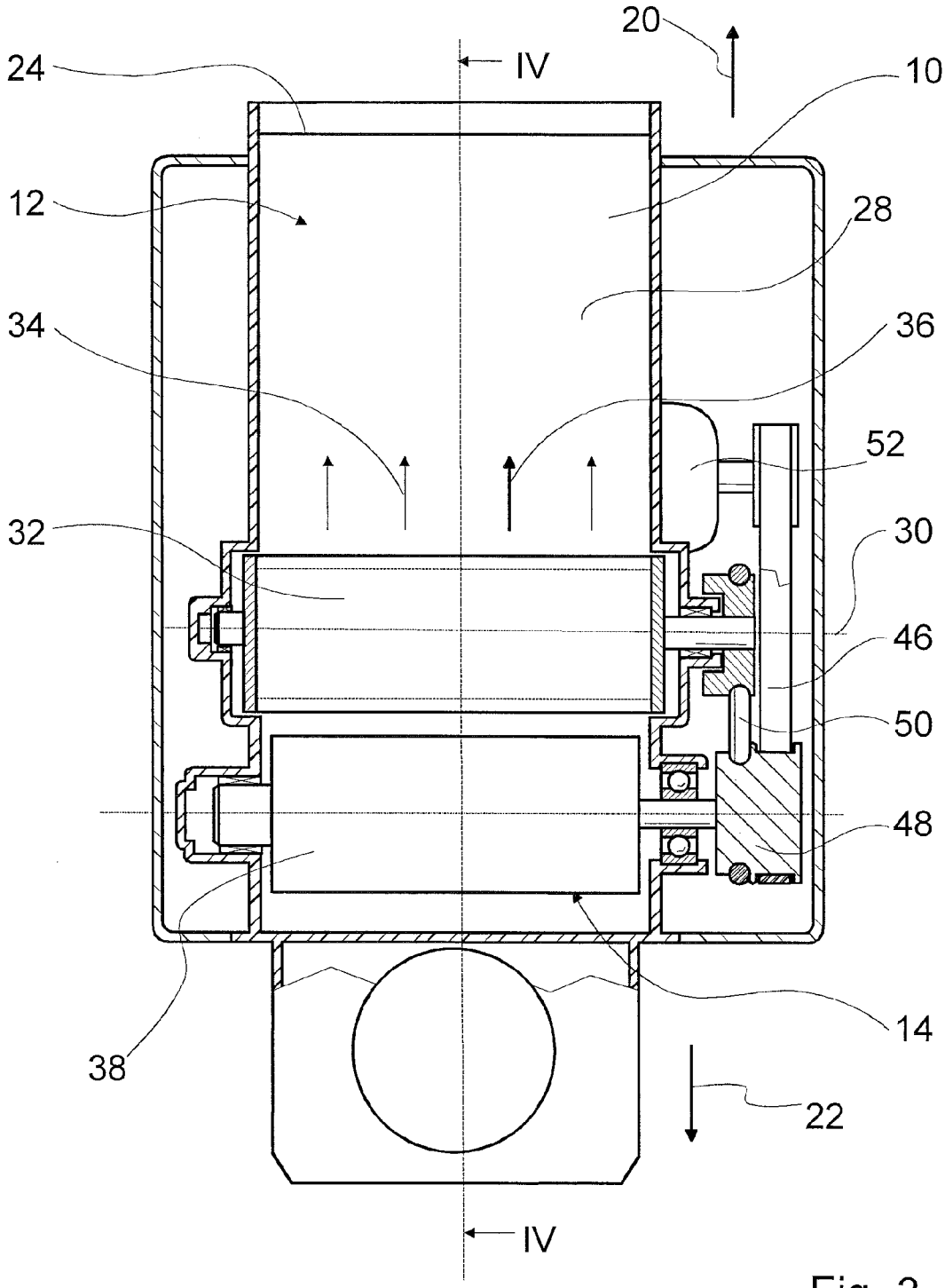
FIG. 3 shows a schematized longitudinal sectional view of the portable power tool in FIGS. 1 and 2.

Axis of rotation 30 of blower unit 32 is displaced downward from the center of guide channel 12, so that air flow 34 is driven by blower unit 32 in direction of flow 36. Blower unit 32 is located above knife shaft 38, displaced slightly to the rear (FIG. 3).

Cylindrical blower unit 32 includes a large number of blades 40 distributed evenly around its circumference, each of which has a sharp edge 42 which points toward the front and, when it engages in stream of air 34, fragmentizes the chips, to make it easier to transport the chips in stream of air 34 via convection.

What is claimed is:

1. A portable power tool comprising:

a housing having at least an upper housing part (44) and a lower housing part (10) pivotably connected with the upper housing part via a hinge element; and a guide channel (12) being formed by the upper and lower housing parts for carrying chips and/or abrasive particles away from a working area (14), the guide channel being opened for cleaning purposes by pivoting the upper housing part about the hinge element away from the lower housing part, wherein the guide channel extends through the portable power tool, from a front region of the lower housing part.

2. The portable power tool as recited in claim 1, further comprising an electric motor located in the lower housing part.

3. The portable power tool as recited in claim 2, wherein a power supply and a switch for turning on and off the electric motor are located in the upper housing part.

4. The portable power tool as recited in claim 2, further comprising a contact element to carry an electric current by a power supply cord via a switch into the lower housing part and/or into the electric motor.

5. The portable power tool as recited in claim 4, wherein the contact element disconnects the electric current when the guide channel is opened for cleaning purposes.

6. The portable power tool as recited in claim 2, wherein the guide channel arches over the electric motor and the electric motor is located transversely to the guide channel.

7. The portable power tool as recited in claim 1, wherein at least one wall region (16) of the guide channel extends at least substantially along an entire length of the guide channel (12).

8. The portable power tool as recited in claim 1, wherein the guide channel (12) is provided to eject chips in one direction (20) which is at least substantially opposite to a working direction (22).

9. The portable power tool as recited claim 1, wherein the guide channel (12) includes a connecting element (24) for connecting a collecting container (26) for the chips and/or abrasive particles.

10. The portable power tool as recited in claim 1, wherein the lower housing part (10) is fixedly connected with a further wall region (28) of the guide channel (12).

11. The portable power tool as recited in claim 10, wherein the guide channel has at least one wall region integrally moulded with the upper housing part and the further wall region is integrally moulded with the lower housing part.

12. The portable power tool as recited in claim 1, further comprising a handle located on the upper housing part.

13. The portable power tool as recited in claim 1, further comprising a snap-in connection for locking the lower housing part to the upper housing part to fix a closed configuration of the guide channel in place.

14. The portable power tool as recited in claim 1, further comprising a collecting container for collecting the chips and/or abrasive particles, the collecting container being connected to the guide channel by a connecting element of the guide channel engaging in a stiff edge of the collecting container to fix the collecting container in position in a form-fit manner.

15. A portable power tool comprising:

a housing having at least an upper housing part and a lower housing part;

an electric motor located in the lower housing part;

a working area;

a hinge element pivotably connecting the upper housing part with the lower housing part;

a guide channel for carrying chips and/or abrasive particles away from the working area; and a collecting container for collecting the chips and/or abrasive particles after being carried through the guide channel, wherein the guide channel includes a connecting element for connecting the collecting container to the guide channel, wherein the collecting container includes a stiff edge which engages in the collecting element to fix the collecting container in position in a form-fit manner, wherein the guide channel is formed by the upper and lower housing parts, wherein a lower wall region of the guide channel is integrally formed with the lower housing part and an upper wall region of the guide channel is integrally formed with the upper housing part, and wherein the guide channel is opened for cleaning purposes by pivoting the upper housing part about the hinge element away from the lower housing part.

16. A portable power tool comprising:

a housing having at least an upper housing part (44) and a lower housing part (10) pivotably connected with the upper housing part via a hinge element;

a guide channel (12) being formed by the upper and lower housing parts for carrying chips and/or abrasive particles away from a working area (14), the guide channel being opened for cleaning purposes by pivoting the upper housing part about the hinge element away from the lower housing part; and an electric motor located in the lower housing part.

17. A portable power tool comprising:

a housing having at least an upper housing part (44) and a lower housing part (10) pivotably connected with the upper housing part via a hinge element;

a guide channel (12) being formed by the upper and lower housing parts for carrying chips and/or abrasive particles away from a working area (14), the guide channel being opened for cleaning purposes by pivoting the upper housing part about the hinge element away from the lower housing part; and a collecting container for collecting the chips and/or abrasive particles, the collecting container being connected to the guide channel by a connecting element of the guide channel engaging in a stiff edge of the collecting container to fix the collecting container in position in a form-fit manner.

* * * * *